US007621218B2

(12) United States Patent
Tokimasa et al.

(10) Patent No.: US 7,621,218 B2
(45) Date of Patent: Nov. 24, 2009

(54) PLATE FEEDING APPARATUS

(75) Inventors: Ryuzo Tokimasa, Kyoto (JP); Hiroshi Miyoshi, Kyoto (JP); Junichi Nagamine, Kyoto (JP); Daisuke Yoneda, Kyoto (JP)

(73) Assignee: Dainippon Screen Mfg. Co. Ltd., Kyoto (JP)

( * ) Notice: Subject to any disclaimer, the term of this patent is extended or adjusted under 35 U.S.C. 154(b) by 0 days.

(21) Appl. No.: 12/076,687

(22) Filed: Mar. 21, 2008

(65) Prior Publication Data

US 2008/0236428 A1 Oct. 2, 2008

(30) Foreign Application Priority Data

Mar. 30, 2007 (JP) ..... 2007-093322

(51) Int. Cl.
*B41L 47/24* (2006.01)

(52) U.S. Cl. ..... 101/477; 101/480; 414/788

(58) Field of Classification Search ..... 101/477, 101/480; 414/788
See application file for complete search history.

(56) References Cited

U.S. PATENT DOCUMENTS

2002/0152910 A1* 10/2002 Ono ..... 101/477
2003/0170099 A1* 9/2003 Ono ..... 414/416.01
2004/0139874 A1* 7/2004 Koizumi et al. ..... 101/477

FOREIGN PATENT DOCUMENTS

JP 2000-247489 9/2000

* cited by examiner

*Primary Examiner*—Leslie J Evanisko
(74) *Attorney, Agent, or Firm*—McDermott Will & Emery LLP

(57) ABSTRACT

A plate feeding apparatus of this invention includes a storage unit 10 for storing a plurality of plates P with end edges thereof arranged even by a stopper 11, a first and a second nip rollers 12 and 13, a suction device 45 disposed at a distal end of an arm 44 swingable about a moving unit 43 for sucking and holding an upper surface adjacent an end edge of each plate, a moving mechanism for moving the moving unit 43 along the surfaces of the plates, and for swinging the arm 44 about the moving unit 43, thereby to invert a portion adjacent the end edge of each plate sucked and held by the suction device 45, and subsequently to move the portion to a position to be pinched by the first nip roller or second nip roller, and a storage unit moving mechanism 26 for moving the storage unit 10 in directions perpendicular to the axes of the first and second nip rollers 12 and 13.

10 Claims, 21 Drawing Sheets

PLATE FEEDING APPARATUS

BACKGROUND OF THE INVENTION

1. Field of the Invention

This invention relates to a plate feeding apparatus for transporting stacked printing plates in order from an uppermost plate, and in an inverted state, to a processing unit at a subsequent stage.

2. Description of the Related Art

Japanese Unexamined Patent Publication No. 2000-247489, for example, discloses a plate feeding apparatus for transporting printing plates, in an inverted state, to a nip roller. According to this apparatus, a suction point at a leading end of each plate sucked and held by suction pads is moved to coincide with a cycloid formed when a circle having a radius equal to the turning radius of the suction point rolls over the plate surface. Subsequently, the leading end of the plate is pinched by the nip roller.

Such a plate feeding apparatus that transports printing plates, in an inverted state, to the nip roller has an advantage of transporting the plates reliably without occupying a large space even when transporting relatively large plates.

In such a plate feeding apparatus, plates are usually stacked with end edges made even by a stopper. Then, with the plate feeding apparatus that transports the plates, in an inverted state, to the nip roller, when a distance from a plate storage unit to the nip roller is small for the size of the plates, the rear end of a plate will thrust itself in between the end edges of the plates stacked and the stopper, making it impossible to transport the plate properly.

This inconvenience will be described with reference to FIGS. 21A and 21B. FIGS. 21A and 21B are schematic views showing an operation to transport printing plates P.

No problem arises in transport of printing plates P when, as shown in FIG. 21A, an uppermost plate P is raised at a predetermined angle $\alpha 1$ to the rest of the plates P stacked. On the other hand, when the angle $\alpha 1$ becomes small as shown in FIG. 21B, the end of the plate P adjacent a stopper 201 will take a vertical position. There occurs a phenomenon of the end of the plate P adjacent the stopper 201 thrusting itself in between the end edges of the stacked plates P and the stopper 201. Such a phenomenon causes a problem that the plate P cannot be transported properly.

In order to solve this problem, it is conceivable to secure a sufficiently large distance from the plate storage unit to the nip roller in accordance with the size of the plates. However, the increasingly large printing plates used nowadays will result in the entire apparatus occupying a large space.

SUMMARY OF THE INVENTION

The object of this invention, therefore, is to provide a plate feeding apparatus which can transport plates reliably without enlarging the apparatus.

The above object is fulfilled, according to this invention, by a plate feeding apparatus for transporting plates loaded therein, in order from an uppermost plate, and in an inverted state, to a processing unit at a subsequent stage, the apparatus comprising a storage unit for storing a plurality of plates with end edges made even by a stopper; a first and a second nip rollers arranged in different height positions for transporting the plates from the storage unit to the processing unit at the subsequent stage; a moving unit movable along surfaces of the plates stored in the storage unit and in directions perpendicular to axes of the first and second nip rollers; a holding unit disposed at a distal end of an arm swingable about the moving unit for holding an upper surface adjacent an end edge, remote from the first and second nip rollers, of each of the plates stored in the storage unit; a moving mechanism for moving the moving unit along the surfaces of the plates stored in the storage unit, from a position remote from the first and second nip rollers toward the first and second nip rollers, and for swinging the arm about the moving unit, thereby to invert a portion adjacent the end edge of each plate held by the holding unit, and subsequently to move the portion to a position to be pinched by one of the first nip roller and the second nip roller; and a storage unit moving mechanism for moving the storage unit along the surfaces of the plates stored in the storage unit and in the directions perpendicular to the axes of the first and second nip rollers.

Such plate feeding apparatus can transport plates reliably regardless of the size of the plates and the height of their stack, and that without enlarging the apparatus.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
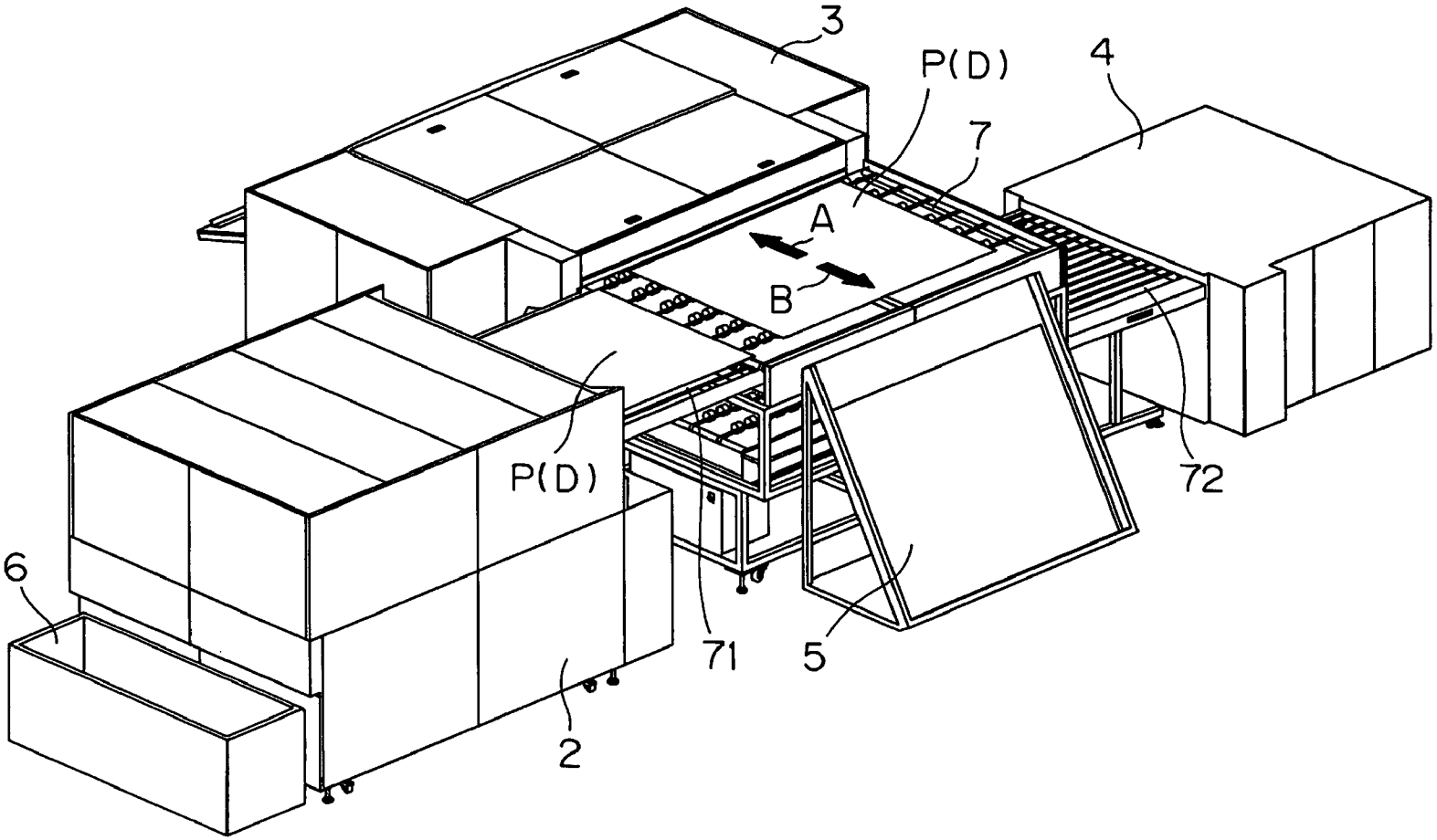
FIG. 1 is a perspective view of an image recording system having a plate feeding apparatus according to this invention.

An embodiment of this invention will be described hereinafter with reference to the drawings. FIG. 1 is a perspective view of an image recording system having a plate feeding apparatus according to this invention.

This image recording system includes an autoloader 2 for fetching and transporting plates P stacked inside, an image recorder 3 for recording images on the plates P, a developing unit 4, a cardboard pad discharge unit 5, a guard paper discharge unit 6, and a transport mechanism 7 having conveyors 71 and 72.

The transport mechanism 7 receives plates P from the autoloader 2, transports the plates P to the image recorder 3, receives cardboard pads D from the autoloader 2, transports the cardboard pads D to the cardboard pad discharge unit 5, and transports to the developing unit 4 the plates P having images recorded thereon by the image recorder 3.

Specifically, the transport mechanism 7 has a pair of transport units arranged one over the other. The upper transport unit receives plates P discharged from the autoloader 2, transports the plates P in a direction perpendicular to the discharge direction to the image recorder 3, receives cardboard pads D from the autoloader 2, and transports the cardboard pads D in a direction perpendicular to the discharge direction to the cardboard pad discharge unit 5. The lower transport unit receives plates P discharged from the image recorder 3, and transports the plates P in a direction perpendicular to the discharge direction to the developing unit 4. Such a transport mechanism 7 is disclosed in Japanese Patent Application No. 2006-056227.

Figure 2:
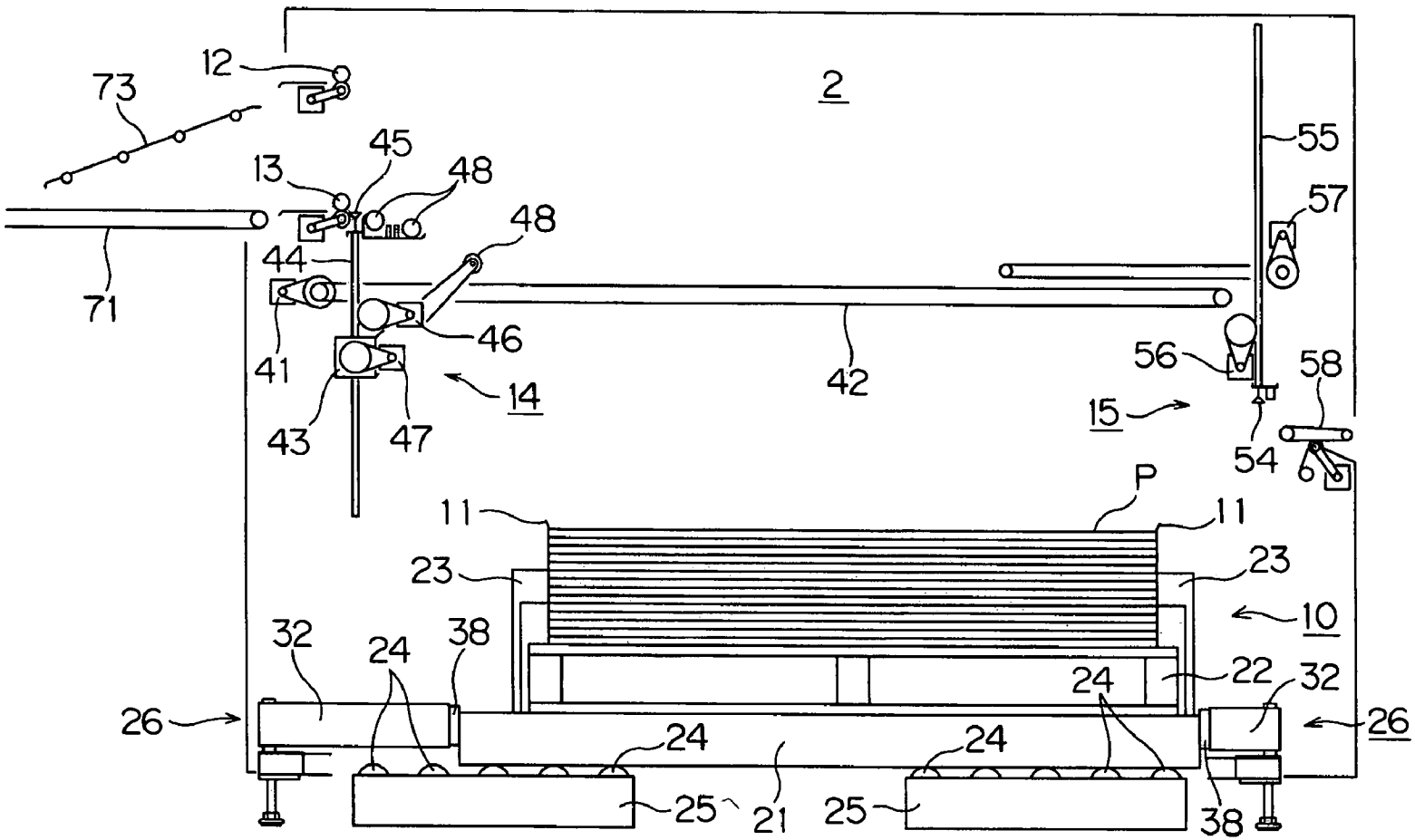
FIG. 2 is a schematic side view of an autoloader.
Figure 3:
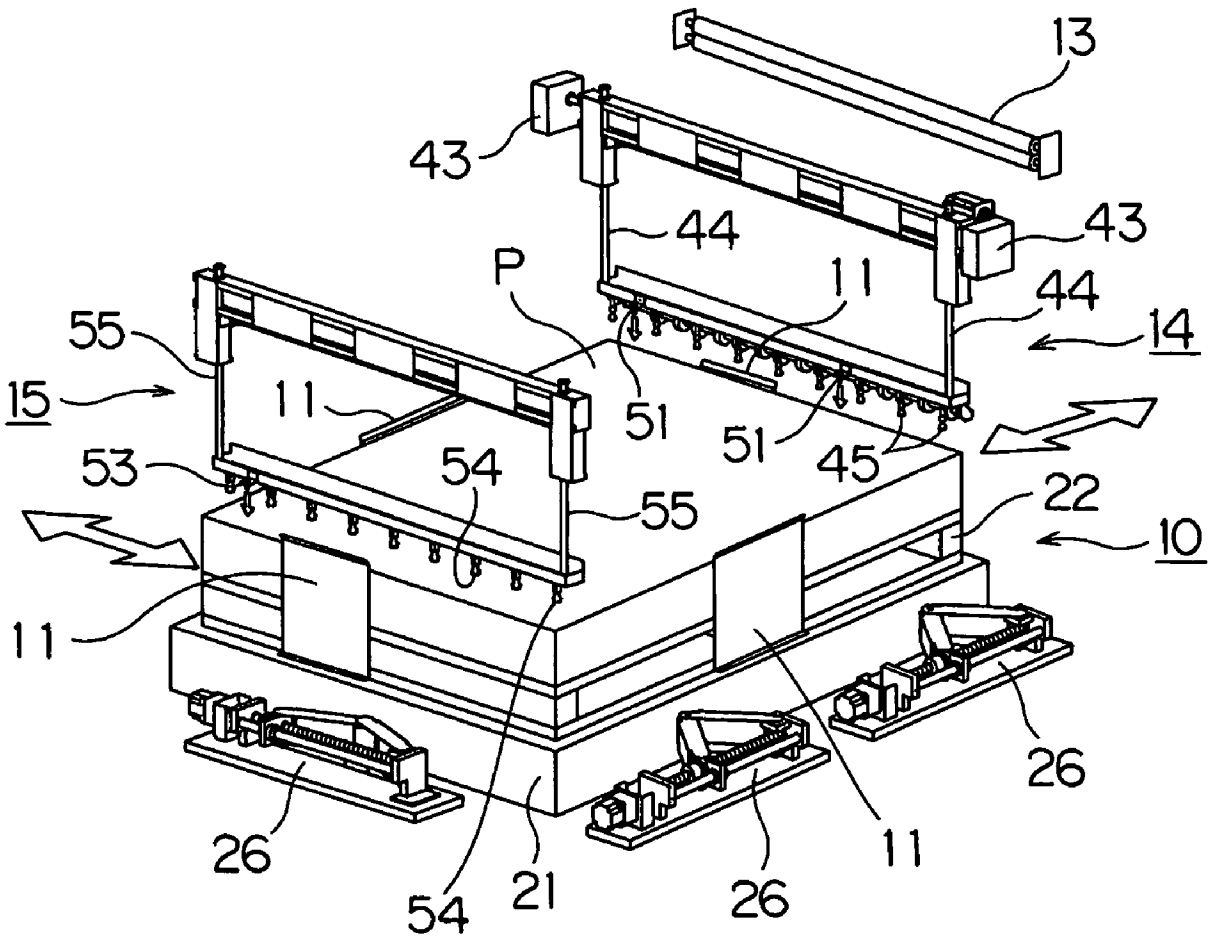
FIG. 3 is a perspective view of the autoloader shown with certain parts thereof omitted.
Figure 4:
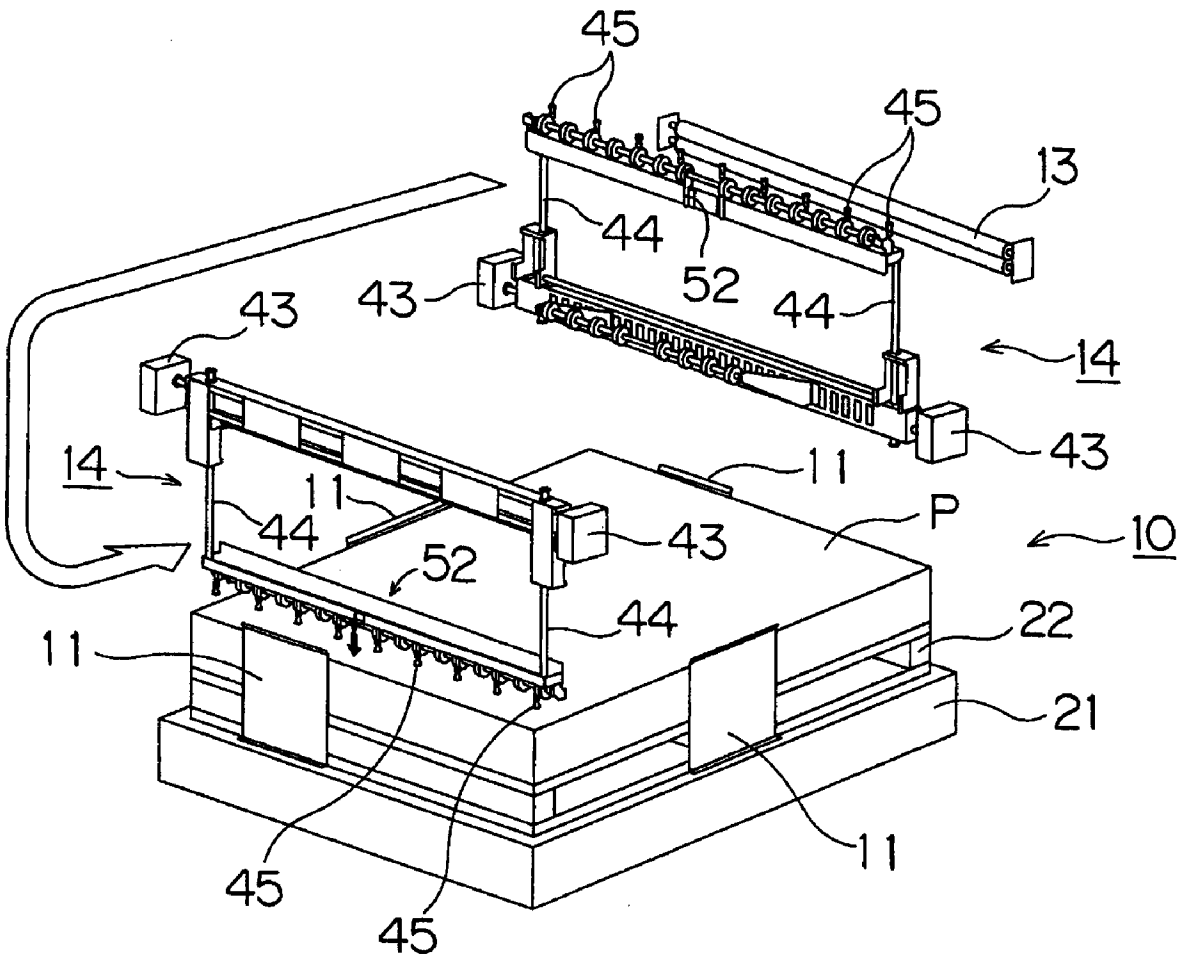
FIG. 4 is a perspective view of the autoloader shown with certain parts thereof omitted.

The above autoloader 2 acts as the plate feeding apparatus according to this invention. The construction of the autoloader 2 will be described hereinafter. FIG. 2 is a schematic side view of the autoloader 2. FIGS. 3 and 4 are perspective views of the autoloader 2 shown with certain parts thereof omitted.

The autoloader 2 includes a storage unit 10 for storing a plurality of plates P stacked along with guard paper and cardboard pads D to have end edges thereof arranged even by stoppers 11, a first and a second nip rollers 12 and 13 for transporting the plates P from the storage unit 10 to the conveyor 71 of transport mechanism 7, a plate transport mechanism 14 for transporting the plates P and cardboard pads D from the storage unit 10, a guard paper transport mechanism 15 for transporting the guard paper from the storage unit 10 to the guard paper discharge unit 6, and storage unit moving mechanisms 26 for moving the storage unit 10 in a plane parallel to the surfaces of the plates P stored therein.

The first nip roller 12 and second nip roller 13 are arranged in different height positions. The second nip roller 13 is disposed in a position opposed to the conveyor 71 of the transport mechanism 7. The first nip roller 12 is disposed in a position opposed to a transport guide 73 disposed above the conveyor 71.

The storage unit 10 includes a skid base 21, a wooden palette 22 for supporting a plurality of plates P, the stoppers 11 for positioning the plates P, and connecting members 23 for fixing the stoppers 11 to the skid base 21. The palette 22 and the plates P loaded on the palette 22 constitute what is called a skid.

The skid base 21 of the storage unit 10 is supported by a support member 25 having numerous rollers 24 arranged on the upper surface thereof. Thus, the storage unit 10 is movable in the plane parallel to the surfaces of plates P stored in the storage unit 10. The storage unit moving mechanisms 26 are arranged around the storage unit 10 for moving the storage unit 10 in the plane parallel to the surfaces of plates P.

Figure 5:
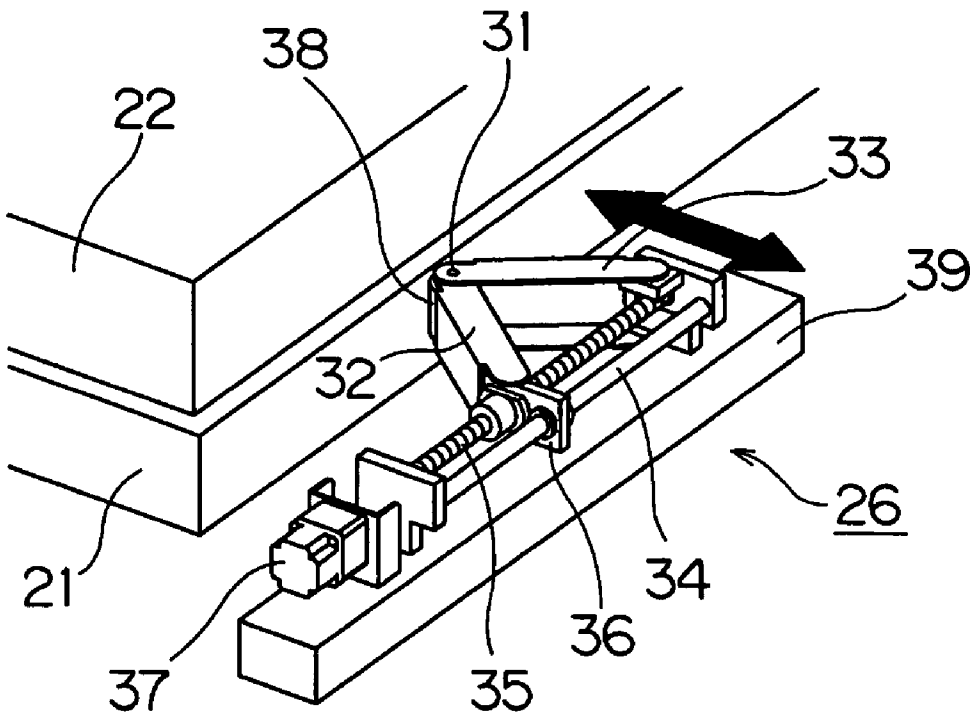
FIG. 5 is an enlarged perspective view of one storage unit moving mechanism.

FIG. 5 is an enlarged perspective view of one of the storage unit moving mechanisms 26.

This storage unit moving mechanism 26 includes a link mechanism of the pantograph type having a pair of arms 32 and 33 hinged together at ends thereof by a pivot 31, and a pressing portion 38. The arm 33 is fixed at the other end to a base 39. The arm 32 has a proximal element 36 fixed to the other end thereof, meshed with a screw 35 rotatable by a motor 37, and guided by a guide member 34. Thus, the distance between the other ends of the pair of arms 32 and 33 is changed by the drive of motor 37, whereby the pressing portion 38 can change its pressing position on the skid base 21 of the storage unit 10.

FIGS. 6 through 9 are schematic views showing the skid base 21 pressed by the storage unit moving mechanisms 26.

Figure 6:
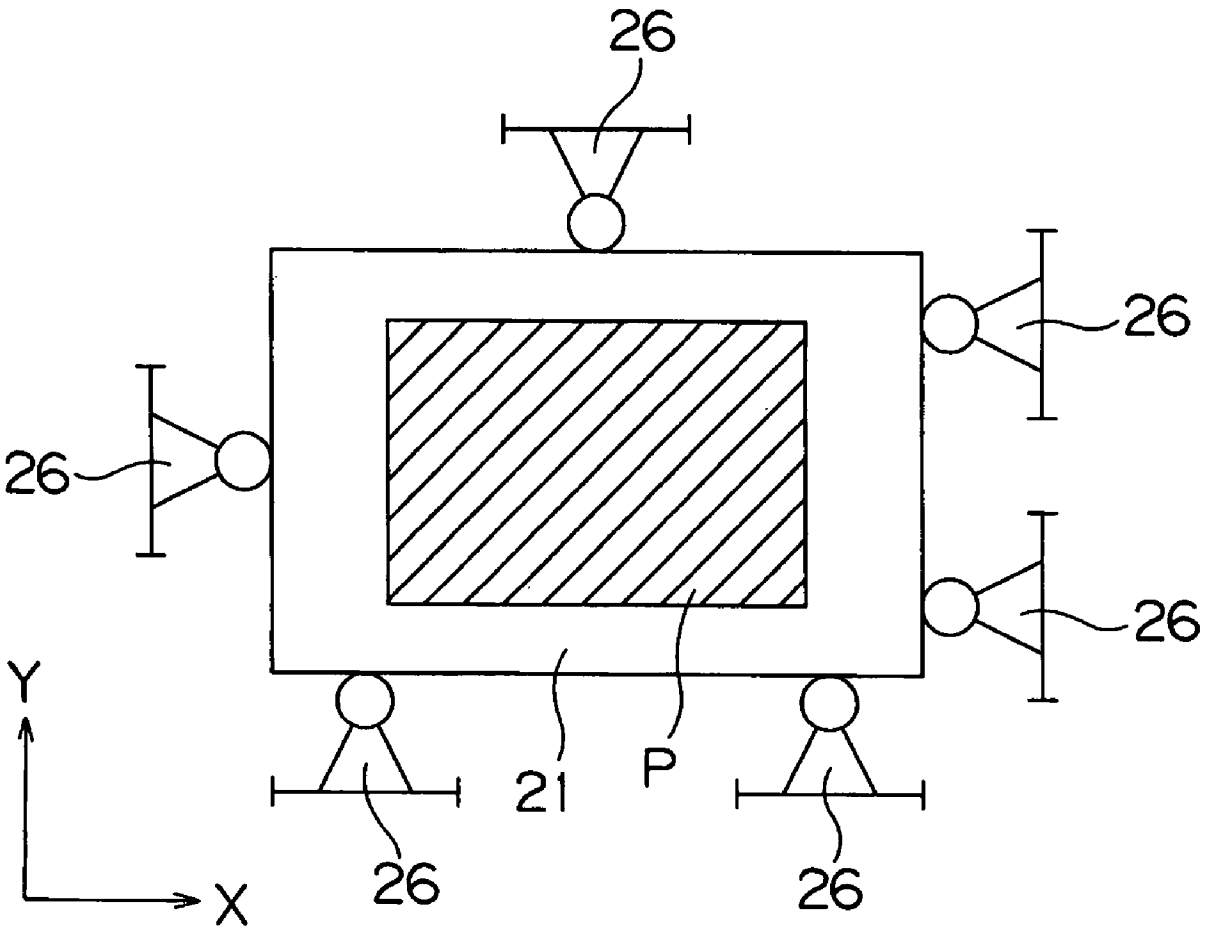
FIG. 6 is a schematic view showing a skid base pressed by storage unit moving mechanisms.

As shown in FIG. 6, the above storage unit moving mechanisms 26 are arranged such that two lie in positions opposed to each of two orthogonal sides of the four sides of the plates P, and one lie in a position opposed to each of the other two orthogonal sides. To put it another way, one storage unit moving mechanism 26 is disposed in a position corresponding to one of the two sides of the plates P extending in the direction of X shown in FIG. 6, two disposed in positions corresponding to the other one side, one disposed in a position corresponding to one of the two sides of the plates P extending in the direction of Y shown in FIG. 6, two disposed in positions corresponding to the other one side.

Figure 7:
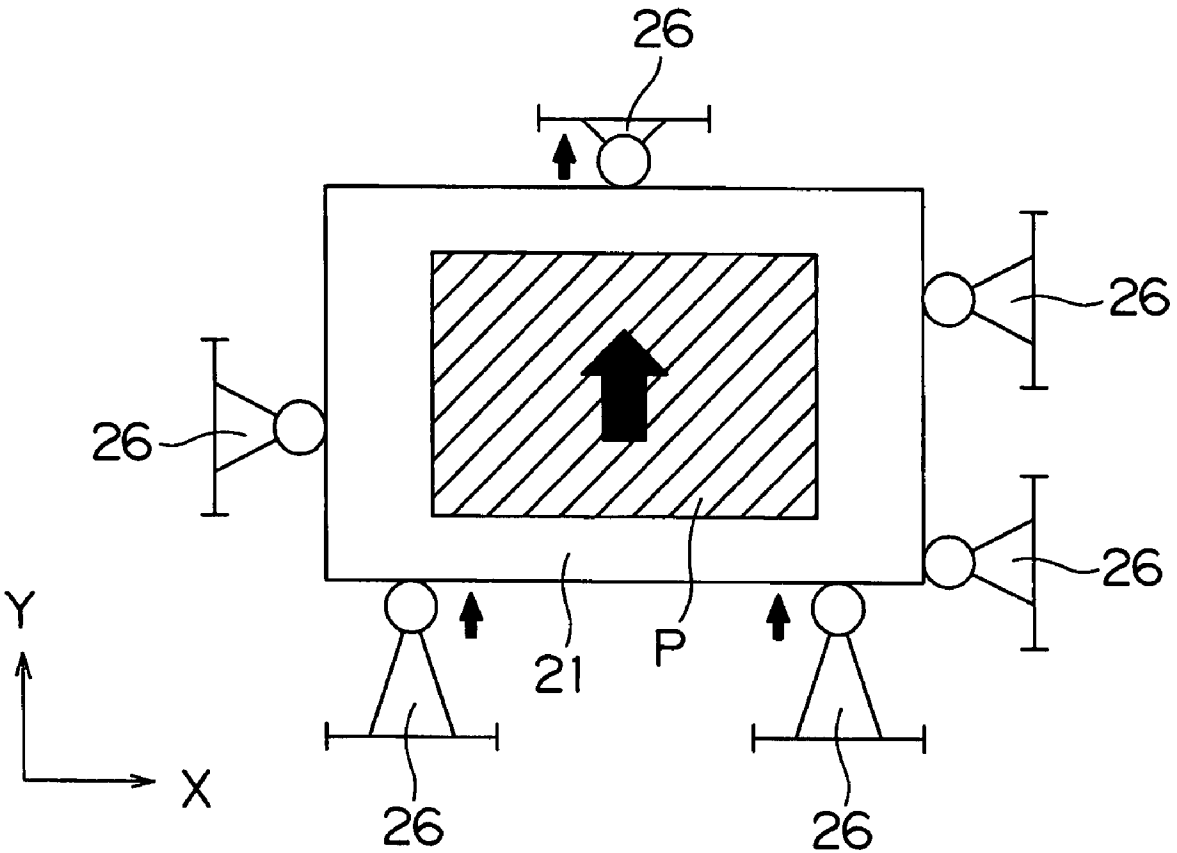
FIG. 7 is a schematic view showing the skid base pressed by the storage unit moving mechanisms.
Figure 8:
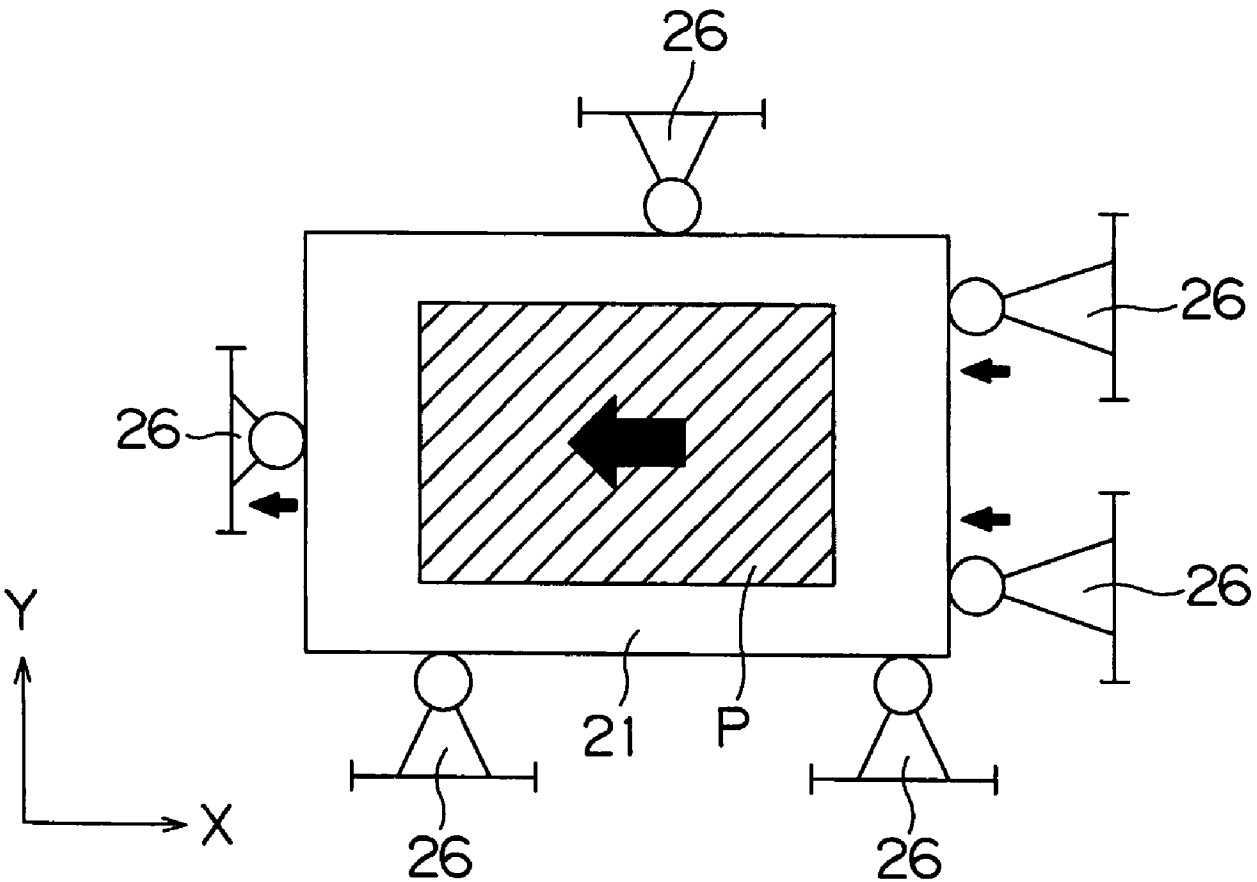
FIG. 8 is a schematic view showing the skid base pressed by the storage unit moving mechanisms.
Figure 9:
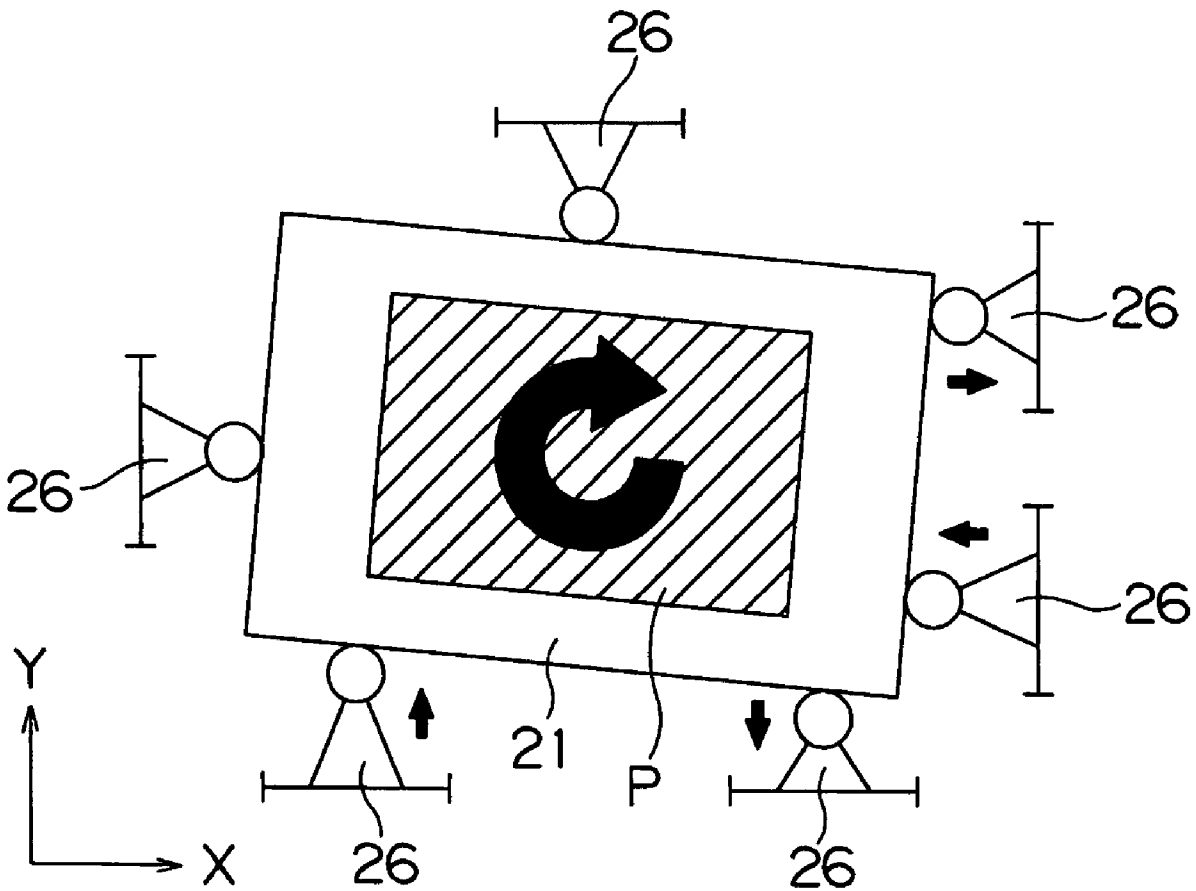
FIG. 9 is a schematic view showing the skid base pressed by the storage unit moving mechanisms.

When moving the plates P with the skid base 21 in the direction of Y, as shown in FIG. 7, the storage unit moving mechanisms 26 corresponding to the sides of the plates P extending in the direction of X are used. Similarly, when moving the plates P with the skid base 21 in the direction of X, as shown in FIG. 8, the storage unit moving mechanisms 26 corresponding to the sides of the plates P extending in the direction of Y are used. When moving the plates P with the skid base 21 in a direction of θ, as shown in FIG. 9, the storage unit moving mechanisms 26 corresponding to the sides of the plates P extending in the direction of X and those corresponding to the sides extending in the direction of Y are used.

With the above construction, positions of plates P stored in the storage unit 10 can be selected as desired. It is therefore possible to move the plates P in the directions of X, Y and θ in the step of positioning the plates P described hereinafter. In the step of transporting the plates P described hereinafter, it is possible to move the plates P in the direction of X which is perpendicular to the axes of the first and second nip rollers 12 and 13.

Reverting to FIGS. 2 through 4, the plate transport mechanism 14 for transporting the plates P and cardboard pads D from the storage unit 10 includes a moving unit 43 connected by a connecting member, not shown, to an endless synchronous belt 42 rotatable by a motor 41, to be reciprocable in directions perpendicular to the axes of the first and second nip rollers 12 and 13 and along the surfaces of the plates P stored in the storage unit 10.

The plate transport mechanism 14 further includes a suction device 45 disposed at a distal end of an arm 44 swingable about the moving unit 43 for sucking and holding positions adjacent the end edge, remote from the first and second nip rollers 12 and 13, on the upper surface of each plate P stored in the storage unit 10, a motor 46 for swinging the arm 44 about the moving unit 43, a motor 47 for moving the arm 44 relative to the moving unit 43, thereby to change the distance along the arm 44 from the moving unit 43 to the suction device 45, and guide rollers 48 for guiding the plates P.

As shown in FIG. 3, the plate transport mechanism 14 has a pair of sensors 51 arranged at one end thereof for detecting the end edge of each plate P. As shown in FIG. 4, the plate transport mechanism 14 has also a sensor 52 disposed at an end thereof remote from the sensors 51 for identifying a plate P, guard paper or cardboard pad D that lies in an uppermost position among the plates P, guard paper and cardboard pads D stored in the storage unit 10.

Referring to FIGS. 2 and 3 again, the guard paper transport mechanism 15 for transporting the guard paper from the storage unit 10 includes a suction device 54 attached to a lower end of an arm 55 for sucking and holding the upper surface of the guard paper, a motor 56 for vertically moving the suction device 54 through the arm 55, and a motor 57 for moving the suction device 54 fore and aft through the arm 55. When discharging the guard paper with the guard paper transport mechanism 15, the motors 56 and 57 are operated to move the suction device 54 to the upper surface of the guard paper, and the suction device 54 sucks and holds the guard paper, and transports the guard paper to a discharge roller mechanism 58. The guard paper is discharged by the discharge roller mechanism 58 to the guard paper discharge unit 6 shown in FIG. 1.

As shown in FIG. 3, the guard paper transport mechanism 15 has sensors 53, similar to the pair of sensors 51 noted above, arranged at one end thereof for detecting the end edge of each plate P.

Figure 10:
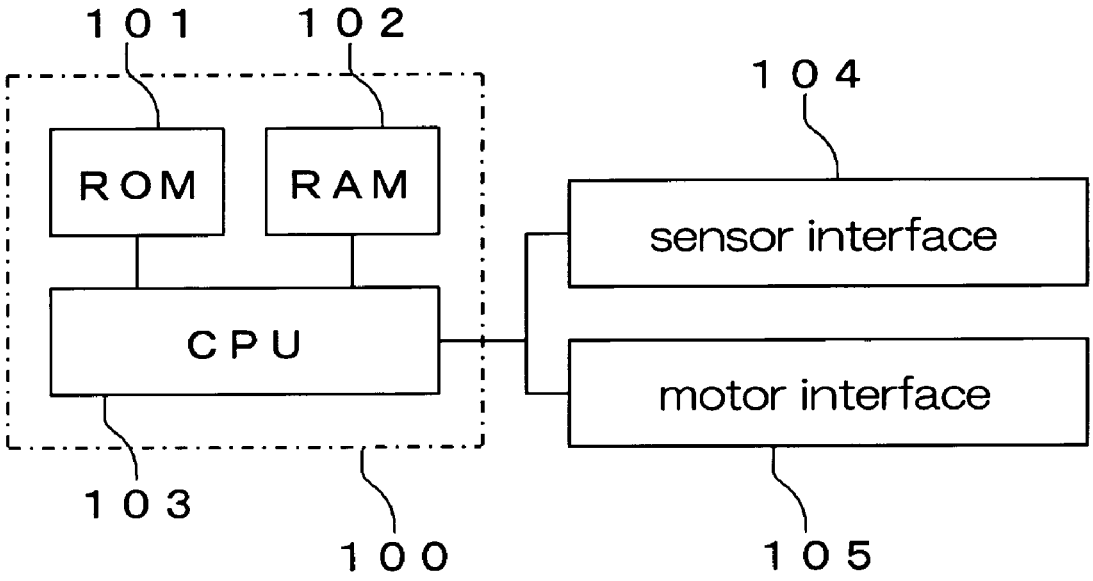
FIG. 10 is a block diagram showing part of an electrical structure of the image recording system.

FIG. 10 is a block diagram showing part of an electrical structure of the image recording system including the autoloader 2 described above.

This image recording system includes a controller 100 having a RAM 102 for temporarily storing data in time of control, a ROM 101 for storing operation programs required for control of the apparatus, and a CPU 103 for performing logical operations. The controller 100 is connected to the above sensors 51, 52 and 53 through a sensor interface 104. The controller 100 is connected also to the above motors 37, 41, 46, 47, 56 and 57 through a motor interface 105.

Figure 11:
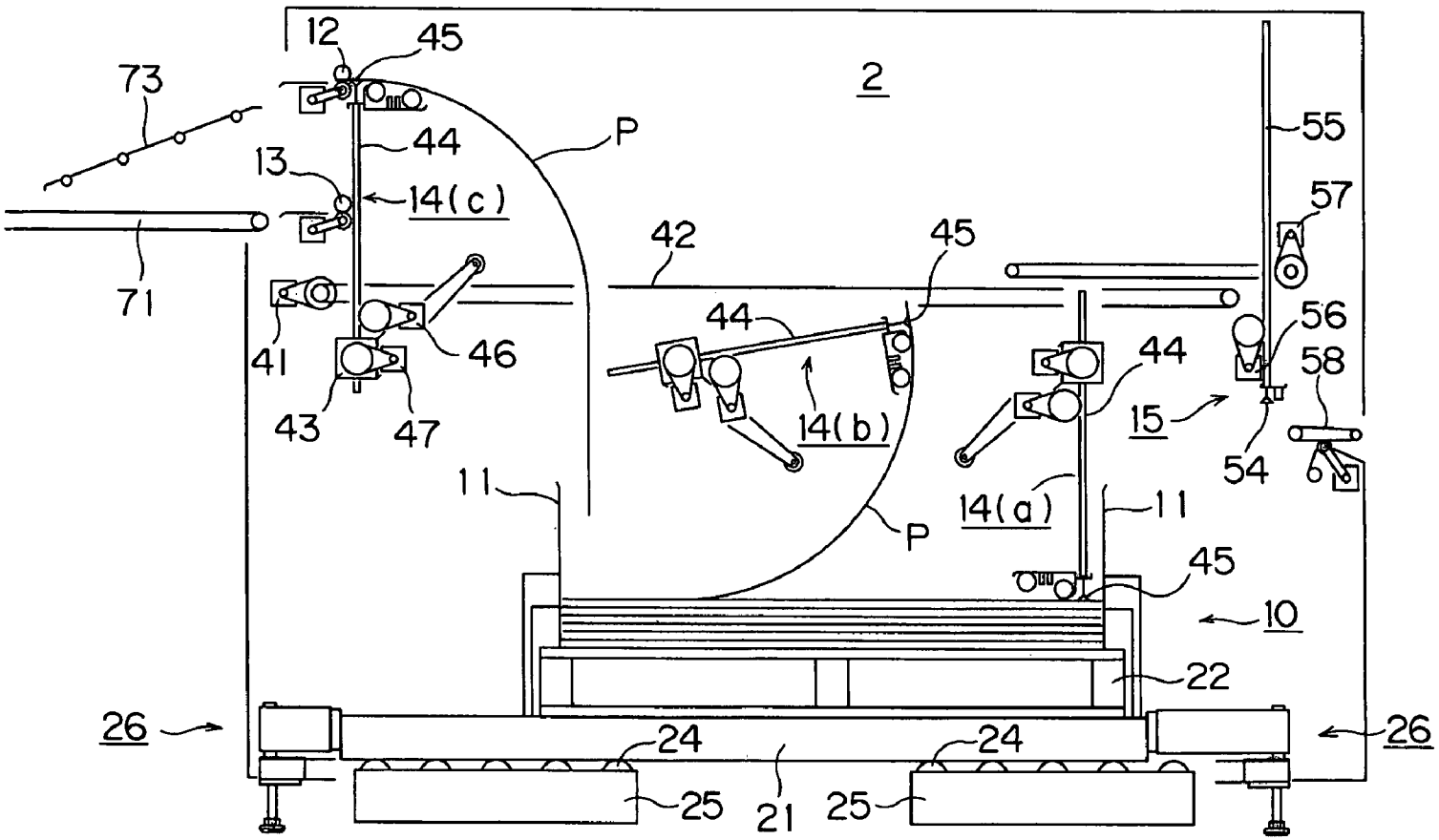
FIG. 11 is an explanatory view showing the autoloader in an operation to transport a printing plate.

Next, an operation of the autoloader 2 to transport a plate P will be described. FIG. 11 is an explanatory view showing the autoloader 2 in the operation to transport a plate P. In FIG. 11, positions of the plate transport mechanism 14 in movement are indicated by affixing references (a), (b) and (c) thereto. The operation for transporting a plate P described hereinafter is carried out by drives of the motors 41, 46 and 47 shown in FIG. 2, whereby the moving unit 43 is moved back and forth, and the arm 44 is swung, extended and retracted.

When the autoloader 2 transports a plate P, the plate transport mechanism 14 is first moved, as indicated by reference 14(*a*), to a position where the suction device 45 can suck an end region on the upper surface of an uppermost plate P, and the suction device 45 sucks and holds the end region of the plate P. In this state, the arm 44 is extended downward.

In this state, the moving unit 43 is driven by the motor 41 to move toward the first and second nip rollers 12 and 13. At the same time, the arm 44 is driven by the motor 46 to swing counterclockwise about the horizontal axis. Consequently, the plate P begins to be turned back as indicated by reference 14(*b*) in FIG. 11.

The movement of the moving unit 43 and swinging of the arm 44 are continued, and so is the changing of the distance between the moving unit 43 and suction device 45 as necessary. As indicated by reference 14(*c*) in FIG. 11, the end edge of the plate P is pinched by the first nip roller 12 (or second nip roller 13). Subsequently, the suction device 45 releases the plate P.

Figure 21A:
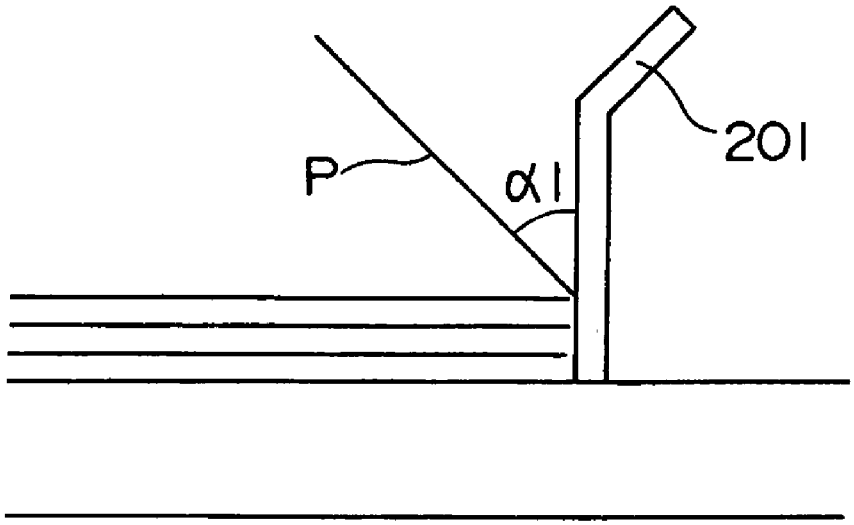
FIG. 21A is an explanatory views showing an operation to transport a printing plate.
Figure 21B:
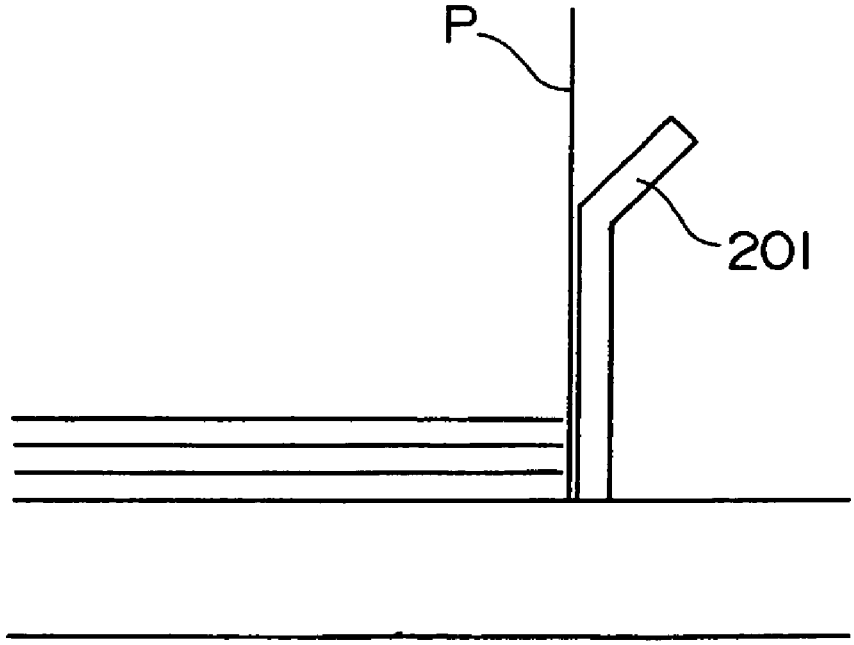
FIG. 21B is an explanatory views showing an operation to transport a printing plate.

When the plate transport mechanism 14 transports a plate P in the above operation, a phenomenon can occur, as shown in FIG. 21B, where the end of the plate P adjacent one of the stoppers 11 takes a vertical position and thrusts itself in between the end edges of the stacked plates P and the stopper 11. In the autoloader 2, therefore, based on the length, in the direction of movement of the moving unit 43, of the plates P stored in the storage unit 10, or the height of the top of the plates P stored in the storage unit 10, the position of plates P is changed by changing the position of the storage unit 10 movable by the storage unit moving mechanisms 26, and selective use is made also of the first and second nip rollers 12 and 13 arranged at different heights. This feature will be described in detail hereinafter.

Next, an image recording operation of the above image recording system will be described.

Figure 12:
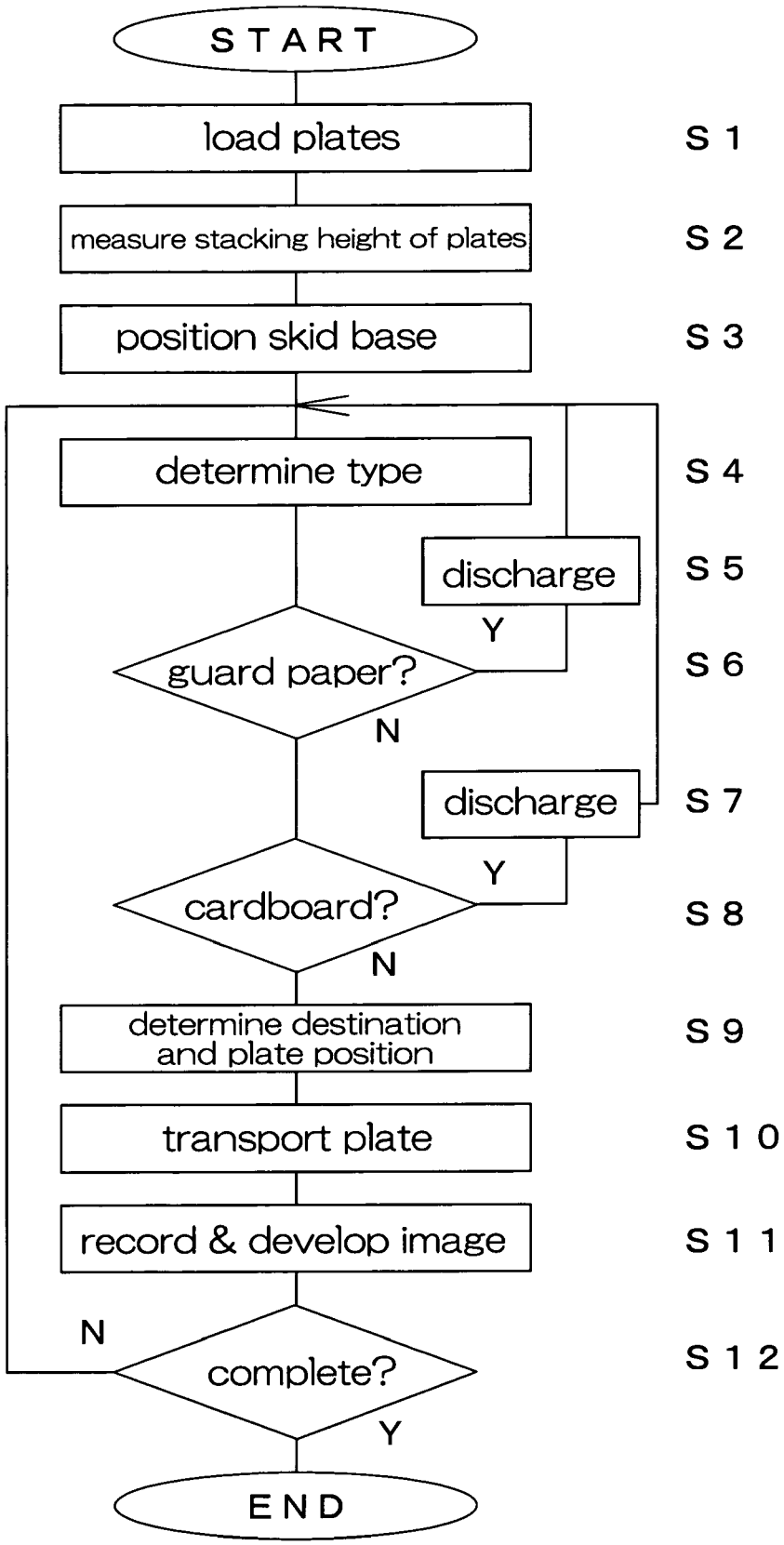
FIG. 12 is a flow chart of an image recording operation of the image recording system.

FIG. 12 is a flow chart of an image recording operation of the image recording system.

When starting an image recording operation, the plates P are loaded first (step S1). At this time, the plates P are in a skid state stacked along with the guard paper and cardboard pads D on the palette 22. A forklift or the like is used to load the plates P. In this state, the plates P have been positioned roughly.

Next, a stacking height of the plates P and so on is measured (step S2). The stacking height is measured using a metal sensor, not shown, provided for the guard paper transport mechanism 15. The suction device 54 of the guard paper transport mechanism 15 is lowered with the arm 55, to determine a height at which the metal sensor not shown detects the plates P and turns on.

Next, the skid base 21 is positioned to position the plates P and so on (step S3). At this time, the positions of the edges of the plates P and so on are measured in three locations by the pair of sensors 51 attached to the plate transport mechanism 14 and the sensor 53 attached to the guard paper transport mechanism 15 shown in FIG. 3. In this state, as shown in FIG. 5, the motor 37 is operated to change the distance between the other ends of the arms 32 and 33 to change the pressing position of the pressing portion 38 on the skid base 21 of the storage unit 10, thereby moving the skid base 21. While moving the sensors 51 and 53 as necessary, the position of the skid base 21 is checked with the sensors 51 and 53. The skid base 21 is stopped in a desired position.

As described hereinbefore, the plates P are positioned by the stoppers 11 which are fixed to the skid base 21 through the connecting members 23. Consequently, by positioning the skid base 21, the plates P will be positioned through the skid base 21. The operation for positioning the skid base 21 is controlled by the controller 100 shown in FIG. 10.

After the operation for positioning the skid base 21 is completed, an operation for transporting the plates P is started. First, the sensor 52 shown in FIG. 4 first determines whether, among the plates P and so on stored in the storage unit 10, the uppermost one is a plate P, guard paper or cardboard pad D (step S4).

When guard paper is found in the uppermost position (step S6), the guard paper is discharged by the guard paper transport mechanism 15 (step S5). That is, the suction device 54 is moved to the upper surface of the guard paper by the drive of motors 56 and 57, sucks and holds the guard paper and transports it to the discharge roller mechanism 58. The guard paper is discharged by the discharge roller mechanism 58 to the guard paper discharge unit 6 shown in FIG. 1.

When a cardboard pad D is found in the uppermost position (step S8), the cardboard pad D is discharged (step S7). In this case, the plate transport mechanism 14 is first operated to invert and transport the cardboard pad D in the state shown in FIG. 11, to have the first nip roller 12 (or second nip roller 13) pinch an end edge of the cardboard pad D. Then, the conveyor 71 of the transport mechanism 7 shown in FIG. 1 transports the cardboard pad D to the upper transport unit of the transport mechanism 7. The upper transport unit transports the cardboard pad D in the direction perpendicular to the transport direction followed up to then, and the cardboard pad D is discharged to the cardboard pad discharge unit 5.

When a plate P rather than guard paper or cardboard pad D is disposed in the uppermost position, a discharge destination of the plate P in time of plate transport and a position of the plate P are determined first (step S9). Thereafter, an operation for transporting the plate P is started (step S10).

In the autoloader 2, as described hereinbefore, based on the length, in the direction of movement of the moving unit 43, of the plates P stored in the storage unit 10, or the height of the top of the plates P stored in the storage unit 10, the position of plates P is changed by changing the position of the storage unit 10 movable by the storage unit moving mechanisms 26, and selective use is made also of the first and second nip rollers 12 and 13 arranged at different heights.

That is, the position of the storage unit 10 movable by the storage unit moving mechanisms 26 is adjusted, based on the length, in the direction of movement of the moving unit 43, of the plates P stored in the storage unit 10, and the height of the top of the plates P stored in the storage unit 10.

When, for example, the size of plates P is small and the plates P are stacked high, or when the size of plates P is large and the plates P are stacked low, the plates P are transported toward the first nip roller 12. When the size of plates P is small and the plates P are stacked low, or when the size of plates P is large and the plates P are stacked high, the plates P are transported toward the second nip roller 13.

Subsequently, the plate transport mechanism 14 is operated to invert and transport a plate P in the state shown in FIG. 11, to have the first nip roller 12 (or second nip roller 13) pinch an end edge of the plate P and transport the plate P to the transport mechanism 7. The transport mechanism 7 transports the plate P discharged from the autoloader 2, in the direction perpendicular to the discharge direction to the image recording unit 3.

After an image is recorded on the plate P by the image recording apparatus 3, the plate P is transported to the developing unit 4 to be developed (step S11).

Subsequently, the operation returns to step S4 to repeat the process. When a required process is completed, or when no more plate P remains in the storage unit 10 (step S12), the process is ended.

Described next are the features that the position of plates P is changed by changing the position of the storage unit 10 movable by the storage unit moving mechanisms 26, and that selective use is made of the first and second nip rollers 12 and 13 arranged at different heights, both based on the length, in the direction of movement of the moving unit 43, of the plates P stored in the storage unit 10, or the height of the top of the plates P stored in the storage unit 10.

Figure 13:
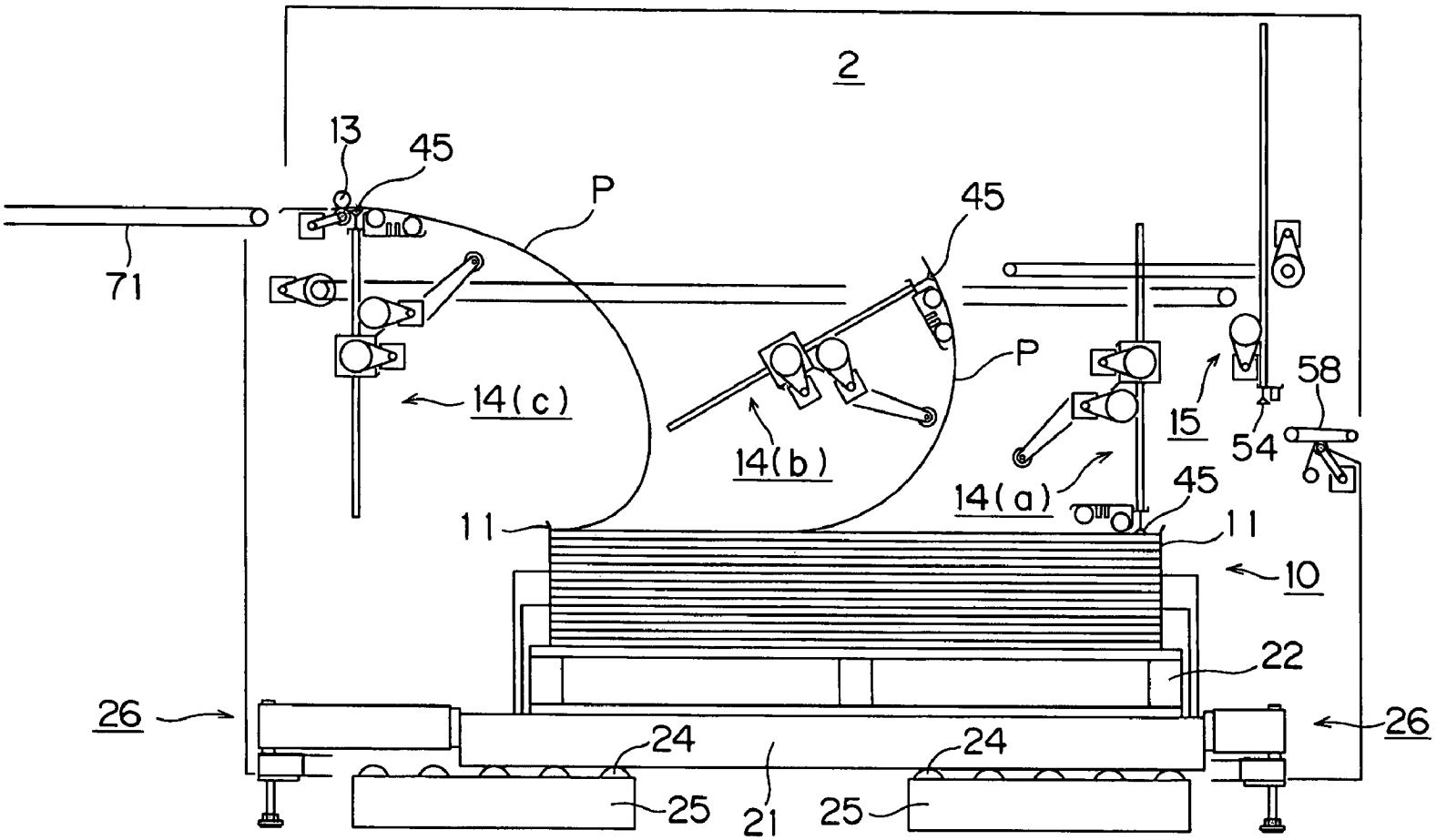
FIG. 13 is an explanatory view showing an operation to transport a printing plate.
Figure 14:
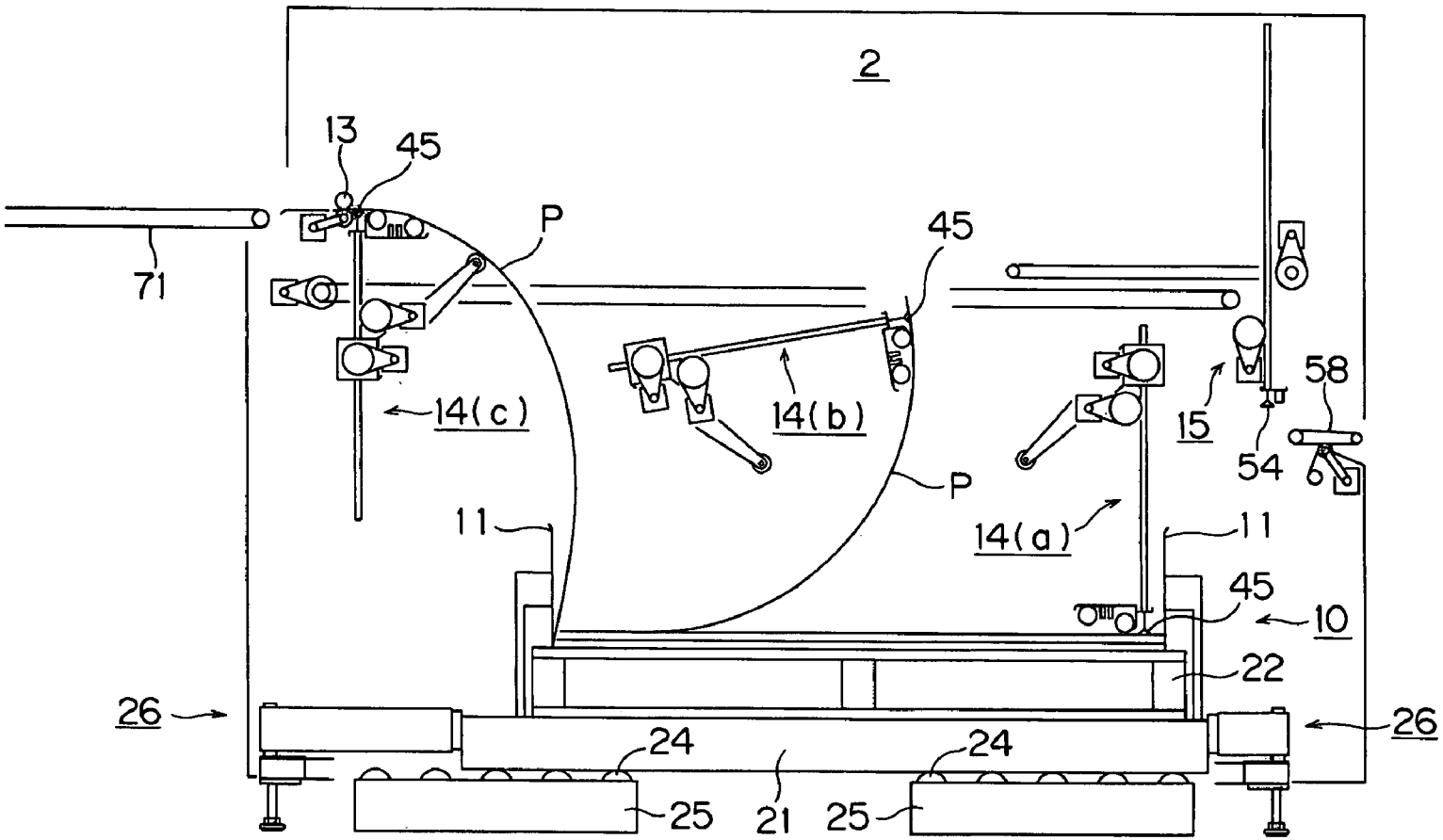
FIG. 14 is an explanatory view showing an operation to transport a printing plate.
Figure 15:
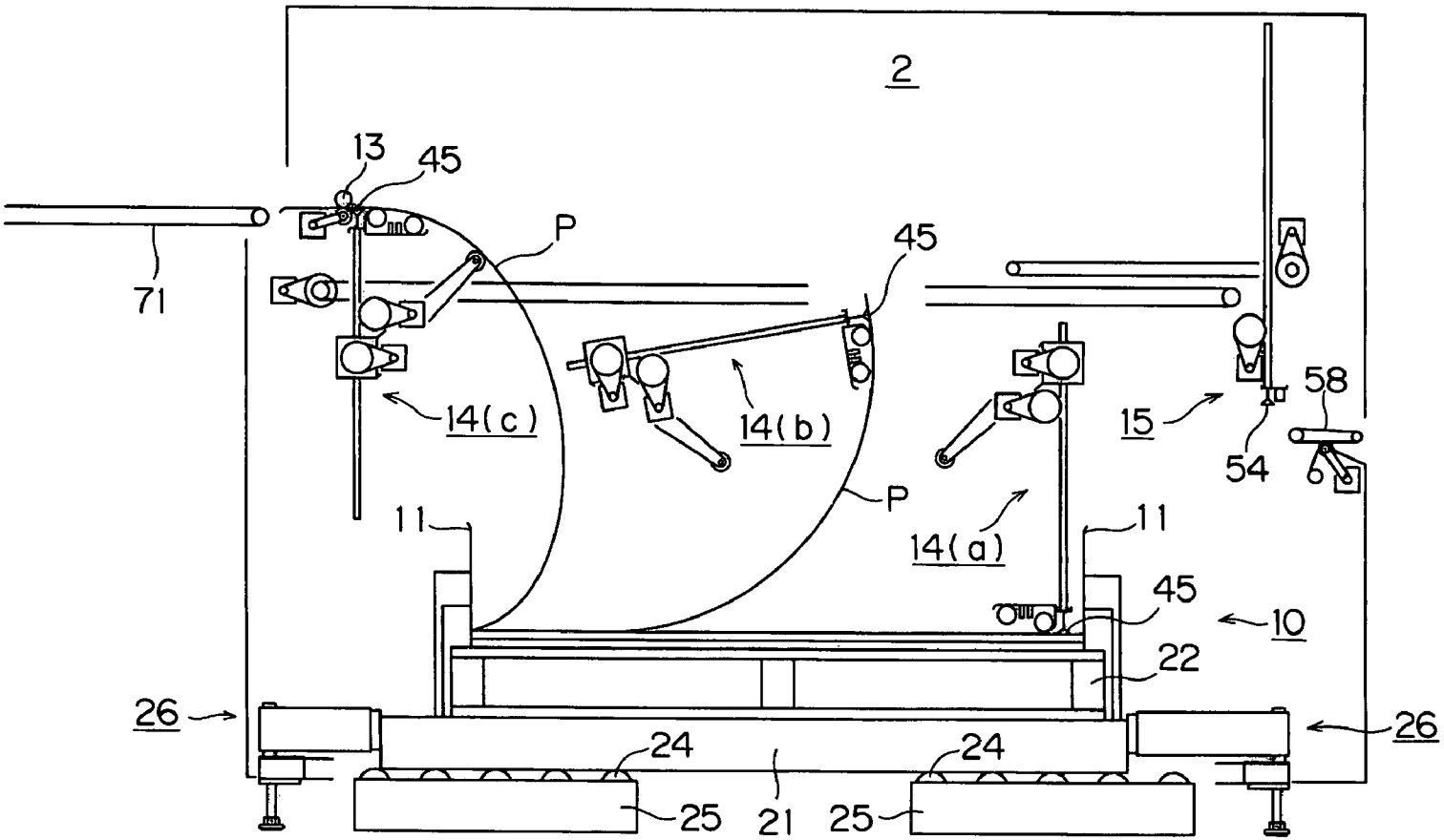
FIG. 15 is an explanatory view showing an operation to transport a printing plate.

The feature that the position of plates P is changed by changing the position of the storage unit 10 movable by the storage unit moving mechanisms 26, based on the length, in the direction of movement of the moving unit 43, of the plates P stored in the storage unit 10, or the height of the top of the plates P stored in the storage unit 10, will be described first. FIGS. 13 through 15 are explanatory views showing such an operation to transport the plates P. This operation uses only one nip roller 13 out of the first and second nip rollers 12 and 13, and the first nip roller 12 is omitted from FIGS. 13 through 15.

In the state shown in FIG. 13, the plate P is transported normally. However, the operation continued to transport the plates P will result in a reduction in the height of stacked plates P. Then, as shown in FIG. 14, when a plate P is being transported to the second nip roller 13, the rear end of the plate P takes a near vertical position. In this case, as in the case shown in FIG. 21B, a phenomenon occurs where the end of the plate P adjacent one of the stoppers 11 takes a vertical position and thrusts itself in between the end edges of the stacked plates P and the stopper 11. Such a phenomenon will give rise to a problem that the plate P cannot be transported properly.

In such a case, as shown in FIG. 15, the storage unit moving mechanisms 26 are operated to move the storage unit 10 in the direction perpendicular to the axis of the second nip roller 13 so that the storage unit 10 may approach the second nip roller 13. As a result, the rear end of the plate P is prevented from taking a vertical position, thereby allowing the plate P to be transported properly.

Next, the feature that selective use is made of the first and second nip rollers 12 and 13 arranged at different heights, based on the length, in the direction of movement of the moving unit 43, of the plates P stored in the storage unit 10, or the height of the top of the plates P stored in the storage unit 10, will be described. FIGS. 16 through 20 are explanatory views showing such an operation to transport the plates P. In FIGS. 16 through 20, the position of the storage unit 10, i.e. that of the plates P, is fixed.

Figure 16:
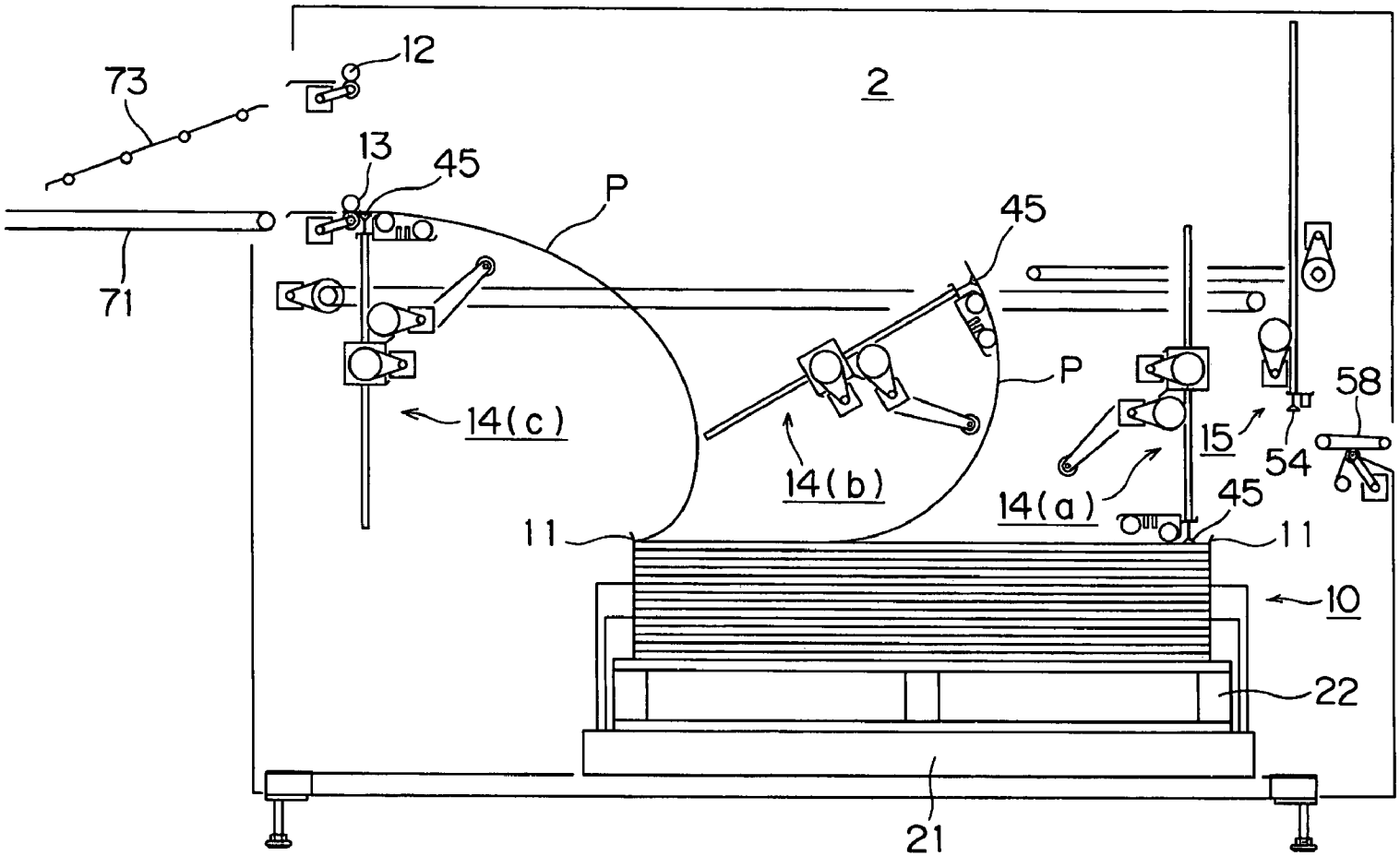
FIG. 16 is an explanatory view showing an operation to transport a printing plate.
Figure 17:
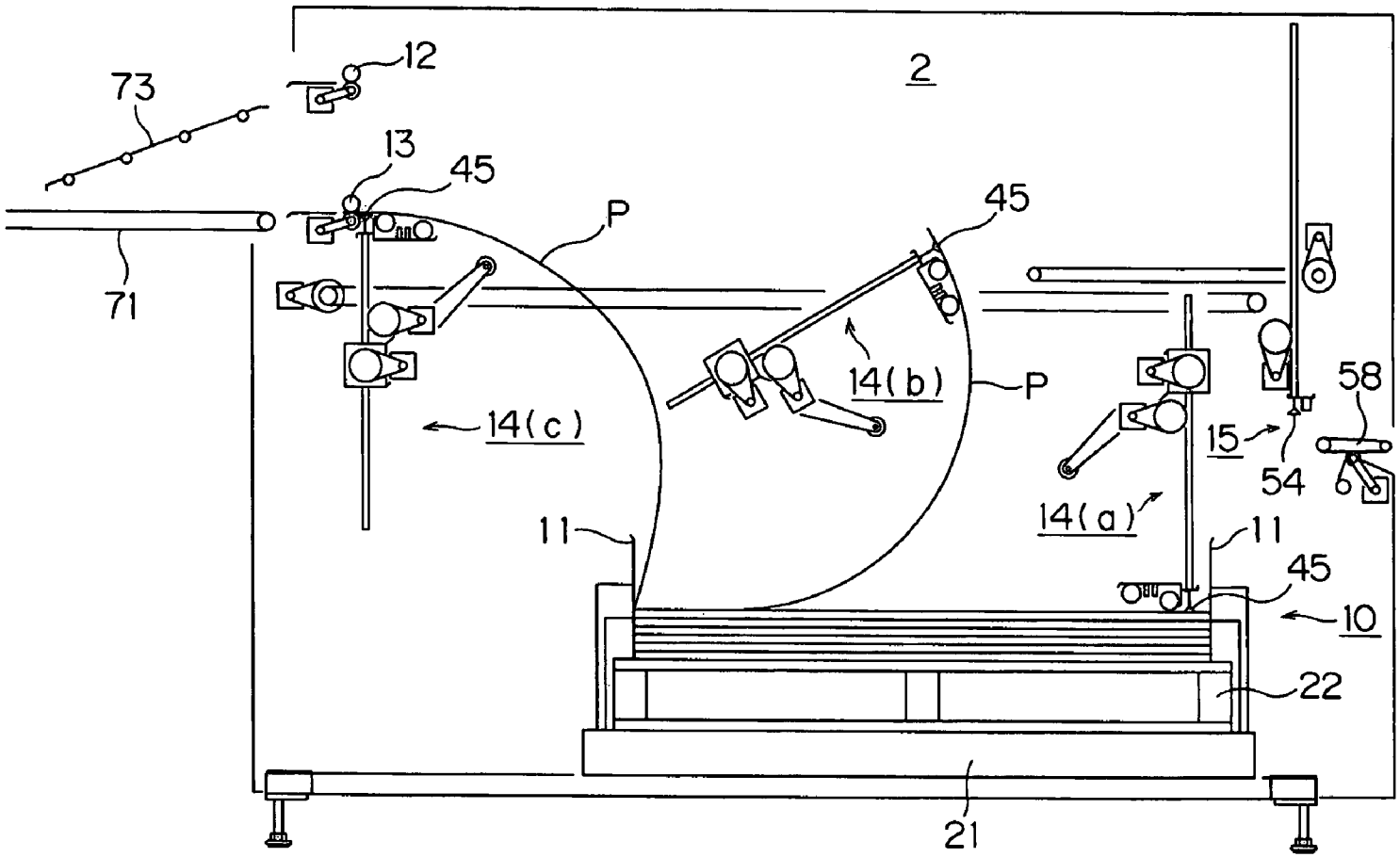
FIG. 17 is an explanatory view showing an operation to transport a printing plate.

In the state shown in FIG. 16, a relatively large plate P is transported normally. However, the operation continued to transport the plates P will result in a reduction in the height of stacked plates P. Then, as shown in FIG. 17, when a plate P is being transported to the second nip roller 13, the rear end of the plate P takes a near vertical position. Then, a phenomenon occurs where the end of the plate P adjacent one of the stoppers 11 takes a vertical position and thrusts itself in between the end edges of the stacked plates P and the stopper 11. Such a phenomenon will give rise to a problem that the plate P cannot be transported properly.

Figure 18:
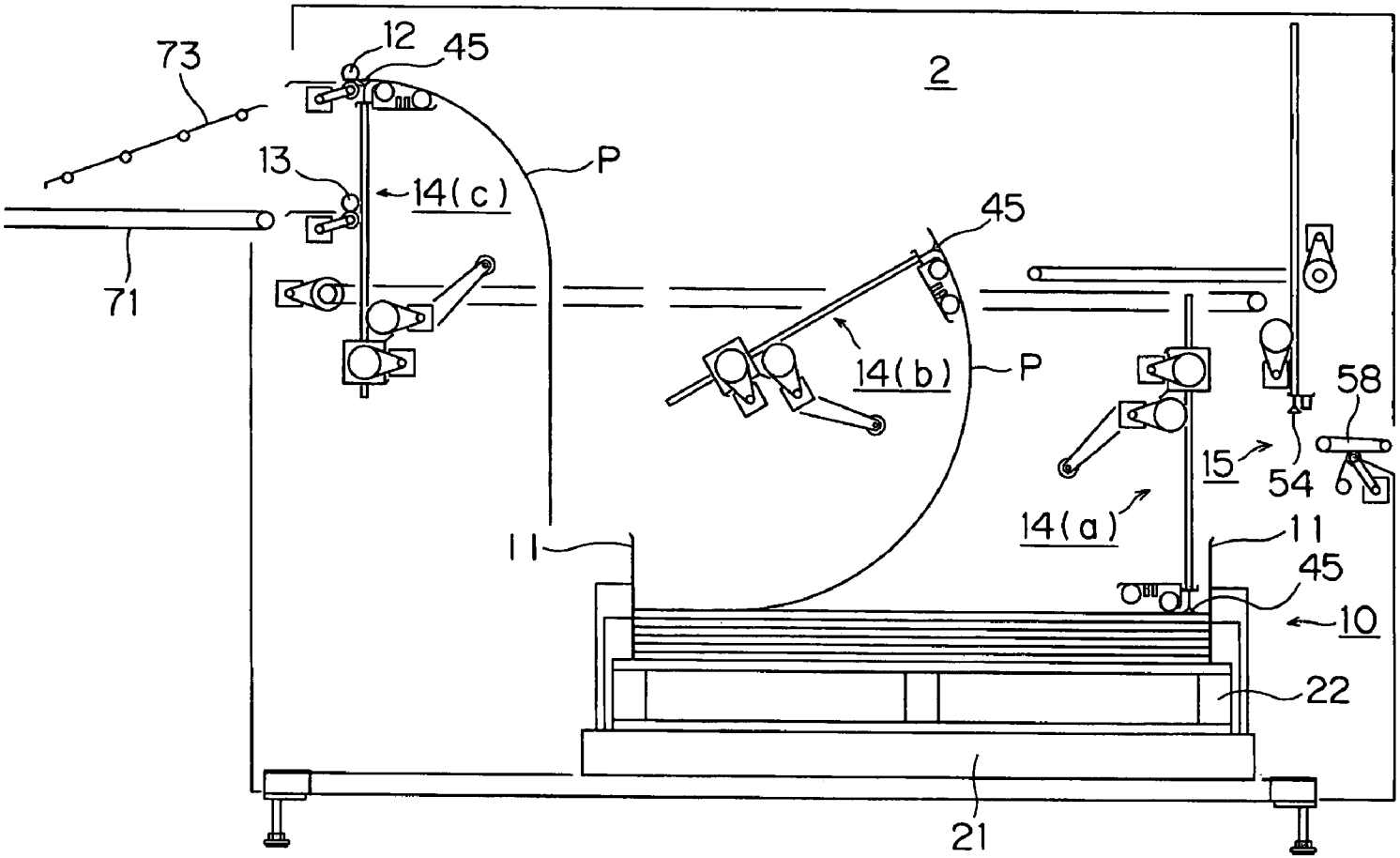
FIG. 18 is an explanatory view showing an operation to transport a printing plate.

In such a case, as shown in FIG. 18, the plate P is transported toward the first nip roller 12. As a result, the rear end of the plate P is prevented from taking a vertical position, thereby allowing the plate P to be transported properly.

Figure 19:
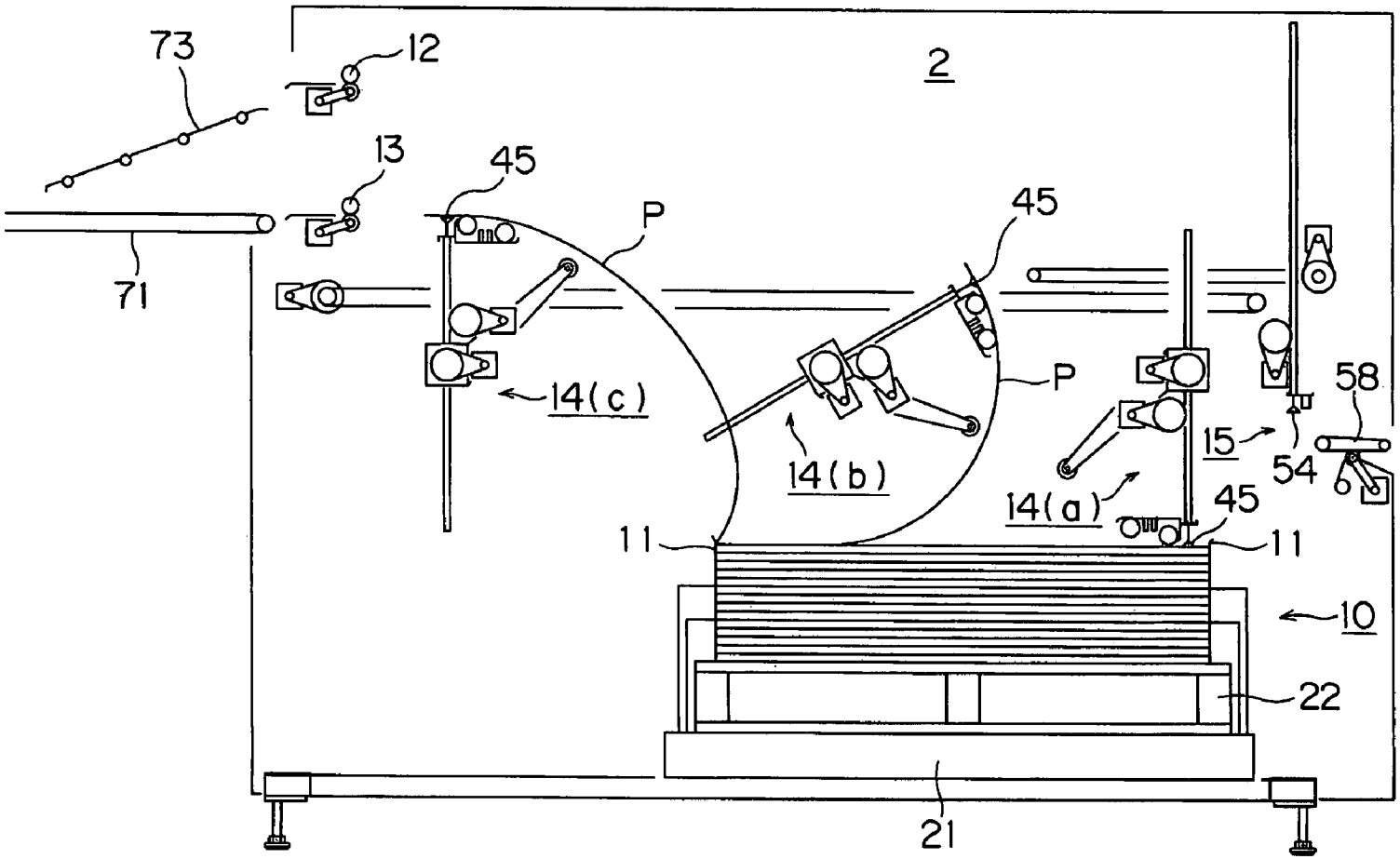
FIG. 19 is an explanatory view showing an operation to transport a printing plate.

Also in a state as shown in FIG. 16, where a relatively small plate P is used, a phenomenon occurs when the plate P is being transported to the second nip roller 13, as shown in FIG. 19, the rear end of the plate P takes a near vertical position, and the end of the plate P adjacent one of the stoppers 11 thrusts itself in between the end edges of the stacked plates P and the stopper 11.

Figure 20:
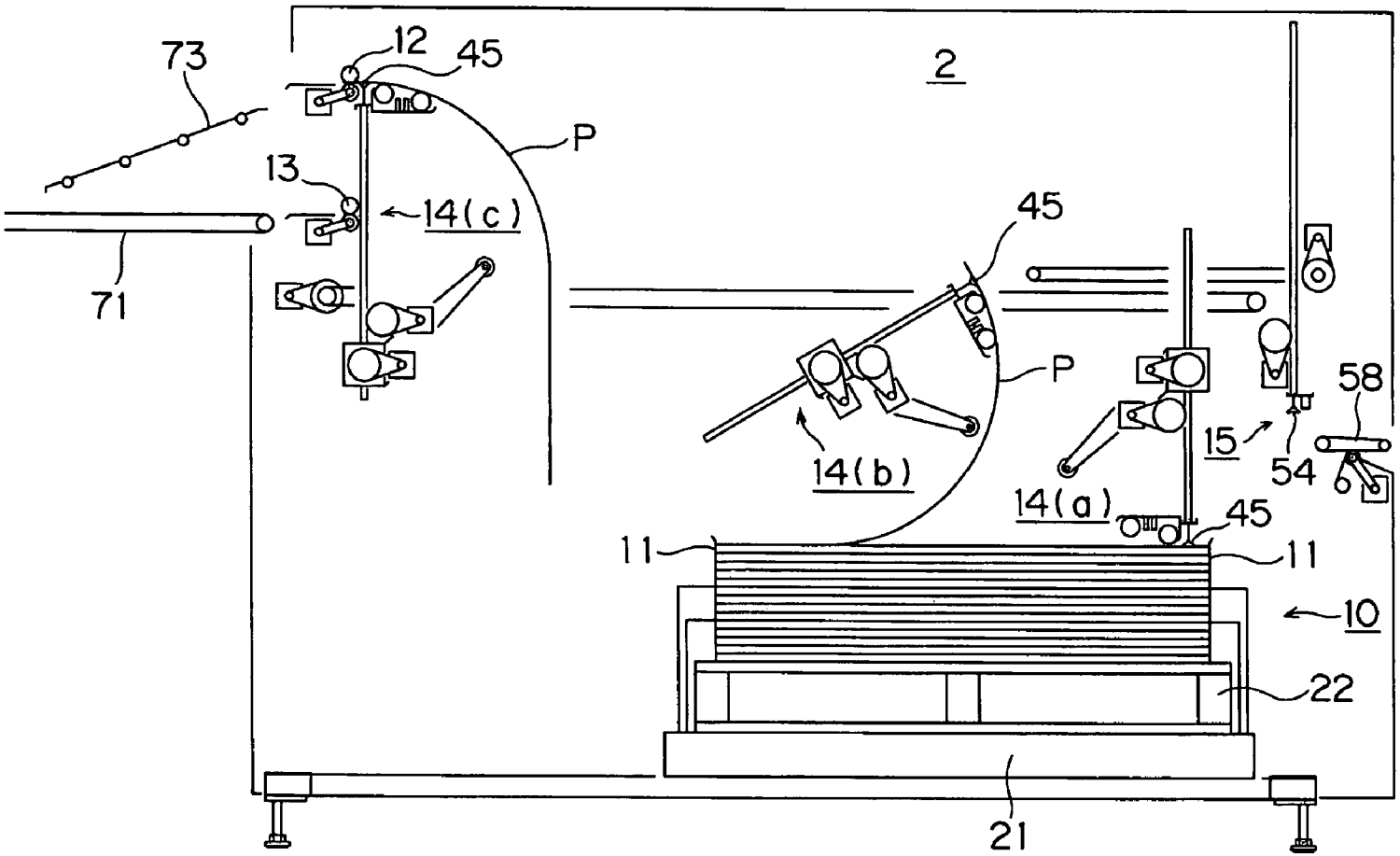
FIG. 20 is an explanatory view showing an operation to transport a printing plate.

In this case also, as shown in FIG. 20, the plate P is transported toward the first nip roller 12. As a result, the rear end of the plate P is prevented from taking a vertical position, thereby allowing the plate P to be transported properly.

In the example shown in FIGS. 13 through 15, only one of the first and second nip rollers 12 and 13 is used. In the example shown in FIGS. 16 through 20, the position of the storage unit 10 is fixed. Instead, these options may be combined as shown in FIGS. 2 and 11, to be able to transport all types of plates P properly. However, this invention is not limited to such a mode. Only one of the first and second nip rollers 12 and 13 may be used. In FIGS. 16 through 20, when the position of the storage unit 10 is fixed, only one of the first and second nip rollers 12 and 13 may be used, based on the length, in the direction of movement of the moving unit 43, of the plates P stored in the storage unit 10, or the height of the top of the plates P stored in the storage unit 10.

In the foregoing embodiment, the plates P are sucked and held by the suction device 45, while the guard paper is sucked and held by the suction device 54. However, the holding device is not limited to the suction type as long as the plates P and guard paper can be held reliably. For example, the plates P may be held by using a hook-like member. A pair of rollers rotatable in opposite directions may be used to hold the guard paper as drawn in between these rollers. It is also possible to use magnetism, static electricity or the like.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2007-093322 filed in the Japanese Patent Office on Mar. 30, 2007, the entire disclosure of which is incorporated herein by reference.

What is claimed is:

1. A plate feeding apparatus for transporting plates loaded therein, in order from an uppermost plate, and in an inverted state, to a processing unit at a subsequent stage, said apparatus comprising:

a storage unit for storing a plurality of plates with end edges made even by a stopper;

a first pair of nip rollers and a second pair of nip rollers, each pair of nip rollers including two rollers and used to transport the plates by pressing and holding the plates, arranged in different height positions for transporting the plates from said storage unit to the processing unit at the subsequent stage;

a moving unit movable in a direction along the surfaces of the plates stored in said storage unit and in directions perpendicular to axes of said first pair of nip rollers and said second pair of nip rollers;

a holding unit disposed at a distal end of an arm swingable about said moving unit for holding an upper surface adjacent an end edge, remote from said first pair of nip rollers and said second pair of nip rollers, of each of the plates stored in said storage unit;

a moving mechanism for moving said moving unit in a direction along the surfaces of the plates stored in said storage unit, from a position remote from said first pair of nip rollers and said second pair of nip rollers toward said first pair of nip rollers and said second pair of nip rollers, and for swinging said arm about said moving unit, thereby to invert a portion adjacent the end edge of each plate held by said holding unit, and subsequently to move said portion to a position to be pinched by one of said first pair of nip rollers and said second pair of nip rollers; and a storage unit moving mechanism for moving said storage unit in a direction along the surfaces of the plates stored in the storage unit and in the direction perpendicular to the axes of said first pair of nip rollers and said second pair of nip rollers so as to prevent the rear end of each plate from thrusting itself in between the end edges of the stacked plates and the stopper resulting from the rear end of each plate taking a vertical position in transporting the plates.

2. A plate feeding apparatus as defined in claim 1, further comprising a controller which, by said storage unit moving mechanism, moves a position of said storage unit responsive to one of a length, in a direction of movement of said moving unit, of the plates stored in said storage unit, and a height of a top of the plates stored in said storage unit.

3. A plate feeding apparatus as defined in claim 1, further comprising a controller which, by said moving unit, selectively moves said portion adjacent the end edge of each plate held by said holding unit to be pinched by one of said first pair of nip rollers and said second pair of nip rollers, responsive to one of a length, in a direction of movement of said moving unit, of the plates stored in said storage unit, and a height of a top of the plates stored in said storage unit.

4. A plate feeding apparatus as defined in claim 1, wherein said holding unit includes a suction device for sucking and holding each of said plates.

5. A plate feeding apparatus for transporting plates loaded therein, in order from an uppermost plate, and in an inverted state, to a processing unit at a subsequent stage, said apparatus comprising:

a storage unit for storing a plurality of plates with end edges made even by a stopper;

a nip roller for transporting the plates from said storage unit to the processing unit at the subsequent stage;

a moving unit movable in a direction along the surfaces of the plates stored in said storage unit and in directions perpendicular to an axis of said nip roller;

a holding unit disposed at a distal end of an arm swingable about said moving unit for holding an upper surface adjacent an end edge, remote from said nip roller, of each of the plates stored in said storage unit;

a moving mechanism for moving said moving unit in a direction along the surfaces of the plates stored in said storage unit, from a position remote from said nip roller toward said nip roller, and for swinging said arm about said moving unit, thereby to invert a portion adjacent the end edge of each plate held by said holding unit, and subsequently to move said portion to a position to be pinched by said nip roller; and a storage unit moving mechanism for moving said storage unit in a direction along the surfaces of the plates stored in the storage unit and in the direction perpendicular to the axis of said nip roller so as to prevent the rear end of each plate from thrusting itself in between the end edges of the stacked plates and the stopper resulting from the rear end of each plate taking a vertical position in transporting the plates.

6. A plate feeding apparatus as defined in claim 5, further comprising a controller which, by said storage unit moving mechanism, moves a position of said storage unit responsive to one of a length, in a direction of movement of said moving unit, of the plates stored in said storage unit, and a height of a top of the plates stored in said storage unit.

7. A plate feeding apparatus as defined in claim 5, wherein said holding unit includes a suction device for sucking and holding each of said plates.

8. A plate feeding apparatus for transporting plates loaded therein, in order from an uppermost plate, and in an inverted state, to a processing unit at a subsequent stage, said apparatus comprising:

a storage unit for storing a plurality of plates with end edges made even by a stopper;

a first pair of nip rollers and a second pair of nip rollers, each pair of nip rollers including two rollers and used to transport the plates by pressing and holding the plates, arranged in different height positions for transporting the plates from said storage unit to the processing unit at the subsequent stage;

a moving unit movable in a direction along the surfaces of the plates stored in said storage unit and in directions perpendicular to axes of said first pair of nip rollers and said second pair of nip rollers;

a holding unit disposed at a distal end of an arm swingable about said moving unit for holding an upper surface adjacent an end edge, remote from said first pair of nip rollers and said second pair of nip rollers, of each of the plates stored in said storage unit; and a moving mechanism for moving said moving unit in a direction along the surfaces of the plates stored in said storage unit, from a position remote from said first pair of nip rollers and said second pair of nip rollers toward said first pair of nip rollers and said second pair of nip rollers, and for swinging said arm about said moving unit, thereby to invert a portion adjacent the end edge of each plate held by said holding unit, and subsequently to move said portion to a position to be pinched by one of said first pair of nip rollers and said second pair of nip rollers.

9. A plate feeding apparatus as defined in claim 8, further comprising a controller which, by said moving unit, selectively moves said portion adjacent the end edge of each plate held by said holding unit to be pinched by one of said first pair of nip rollers and said second pair of nip rollers, responsive to one of a length, in a direction of movement of said moving unit, of the plates stored in said storage unit, and a height of a top of the plates stored in said storage unit.

10. A plate feeding apparatus as defined in claim 8, wherein said holding unit includes a suction device for sucking and holding each of said plates.

* * * * *